US009017125B2

(12) United States Patent
Ventura

(10) Patent No.: US 9,017,125 B2
(45) Date of Patent: Apr. 28, 2015

(54) UNITARY SECURITY ACCESSORY FOR A SURFBOARD

(71) Applicant: Meni Ventura, Tel Aviv (IL)

(72) Inventor: Meni Ventura, Tel Aviv (IL)

(73) Assignee: C Flawless Aquatic Solution Ltd., Tel Aviv (IL)

( * ) Notice: Subject to any disclaimer, the term of this patent is extended or adjusted under 35 U.S.C. 154(b) by 90 days.

(21) Appl. No.: 13/849,507

(22) Filed: Mar. 24, 2013

(65) Prior Publication Data

US 2014/0287637 A1 Sep. 25, 2014

(51) Int. Cl.
*B63B 35/00* (2006.01)
*B63B 35/79* (2006.01)

(52) U.S. Cl.
CPC ..... *B63B 35/7933* (2013.01)

(58) Field of Classification Search
USPC ..... 441/75
IPC ..... B63B 35/7936
See application file for complete search history.

(56) References Cited

U.S. PATENT DOCUMENTS

| | | | | |
|---|---|---|---|---|
| 5,127,861 | A * | 7/1992 | Ross | 441/75 |
| 5,490,805 | A * | 2/1996 | Bredesen | 441/75 |
| 5,938,492 | A | 8/1999 | Carlini | |
| 6,000,979 | A | 12/1999 | Stewart | |
| 7,371,141 | B1 | 5/2008 | Lin | |
| 2011/0312232 | A1 | 12/2011 | Starck et al. | |
| 2013/0295803 | A1 * | 11/2013 | Pietsch | 441/75 |

* cited by examiner

*Primary Examiner* — Stephen Avila
(74) *Attorney, Agent, or Firm* — JMB Davis Ben-David

(57) ABSTRACT

Provided herein are improvements in surfboard security.

4 Claims, 8 Drawing Sheets

UNITARY SECURITY ACCESSORY FOR A SURFBOARD

FIELD OF THE INVENTION

The present invention relates to improvements in surfboard security.

BACKGROUND OF THE INVENTION

Surfboards are normally provided with a leash which is intended to prevent the loss of a surfboard when it becomes separated from a surfer using the surfboard. The leash is a predetermined length of cable which is attached at one end to the surfboard, and has a cuff at the other end for fastening around the ankle of a user. More recently, it has been suggested to provide retractable leashes. However, they have an inherent disadvantage due to the need to alter the design of the surfboard so as to enable their installation.

Among known art are US Patent Publication No. 2011/0312232 to Starck et al, and the following US Patents: U.S. Pat. No. 5,938,492 to Carlini, U.S. Pat. No. 6,000,979 to Stewart, and U.S. Pat. No. 7,371,141 to Lin.

DEFINITIONS

In the present document, the following terms are used as follows:

"Integral" is intended to mean 'formed into a single unit.' Thus, even though the herein-described security accessory is formed of a number of different components, they are intended to be assembled by a manufacturer into a single accessory, and sold to a consumer for use as a single unit.

"Conventional traction pad" is intended to mean a traction pad as known in the art. Traction pads are abundant in the marketplace, they are wedge shaped, formed of a suitable foam substance and have a "deck" on which a surfer places his rear foot and are intended to assist the surfer in gripping the surfboard.

SUMMARY OF THE INVENTION

The present invention seeks to overcome disadvantages of prior art by providing a security accessory for a surfboard, including a retractable leash assembly whose installation does not require alteration of a surfboard on which it is to be installed.

There is thus provided a unitary security accessory for a surfboard which includes:

a retractable leash assembly including a retractable leash having a first end anchored to an interior anchor location within the leash assembly and a second, free end for attaching to the ankle of a surfer; and a generally wedge shaped body having formed therein a storage compartment for housing the retractable leash assembly, the storage compartment communicating with the exterior so as to facilitate extension and retraction of the leash, the body further having an upper surface for supporting the surfer and a lower surface juxtaposed to an upper rear surface of the surfboard, wherein the lower surface of the body of the accessory is fastened to the upper rear surface of the surfboard so as to mount the accessory thereon.

Additionally, in accordance with an embodiment of the invention, the wedge shaped body has a tapered configuration from a rear edge portion to a front edge portion thereof.

Further, in accordance with an embodiment of the invention, the storage compartment has an opening formed in the lower surface of the body.

Additionally, in accordance with an embodiment of the invention, the leash assembly further includes:

a spring-retained winding mechanism for winding thereon the leash; and a generally disk-shaped casing configured to store the leash in a generally flat wound arrangement, wherein the winding mechanism is mounted within the casing and the casing has a lateral opening adapted to facilitate passage of the leash when being retracted or paid out.

Further, in accordance with an embodiment of the invention, the disk-shaped casing has an overall thickness which is less than the thickness of the body at the location of the storage compartment.

Additionally, in accordance with an embodiment of the invention, the internal dimensions of the storage compartment match the external dimensions of the casing such that the casing is fully engaged by the body when assembled therewith, thereby preventing undesired rotation of the casing relative to the body.

Further, in accordance with an embodiment of the invention, the body includes:

a main body element having a lower surface constituting the lower surface of the body, the storage compartment being formed within the main body element; and a deck element having an upper surface constituting the upper surface for supporting the surfer, wherein a lower surface of the deck element is fastened to an upper surface of the main body element.

Additionally, in accordance with an embodiment of the invention, the disk-shaped casing of the leash assembly terminates in a bottom surface, and the storage compartment is configured so as to contain the entire thickness of the disk-shaped casing such that the bottom surface thereof does not protrude beyond the lower surface of the body when fastened to the surfboard.

Further, in accordance with an embodiment of the invention, the upper surface for supporting the surfer is a traction surface.

BRIEF DESCRIPTION OF THE DRAWINGS

The present invention will be more fully understood from the following detailed description, taken together with the drawings, in which.

DETAILED DESCRIPTION

Figure 1A:
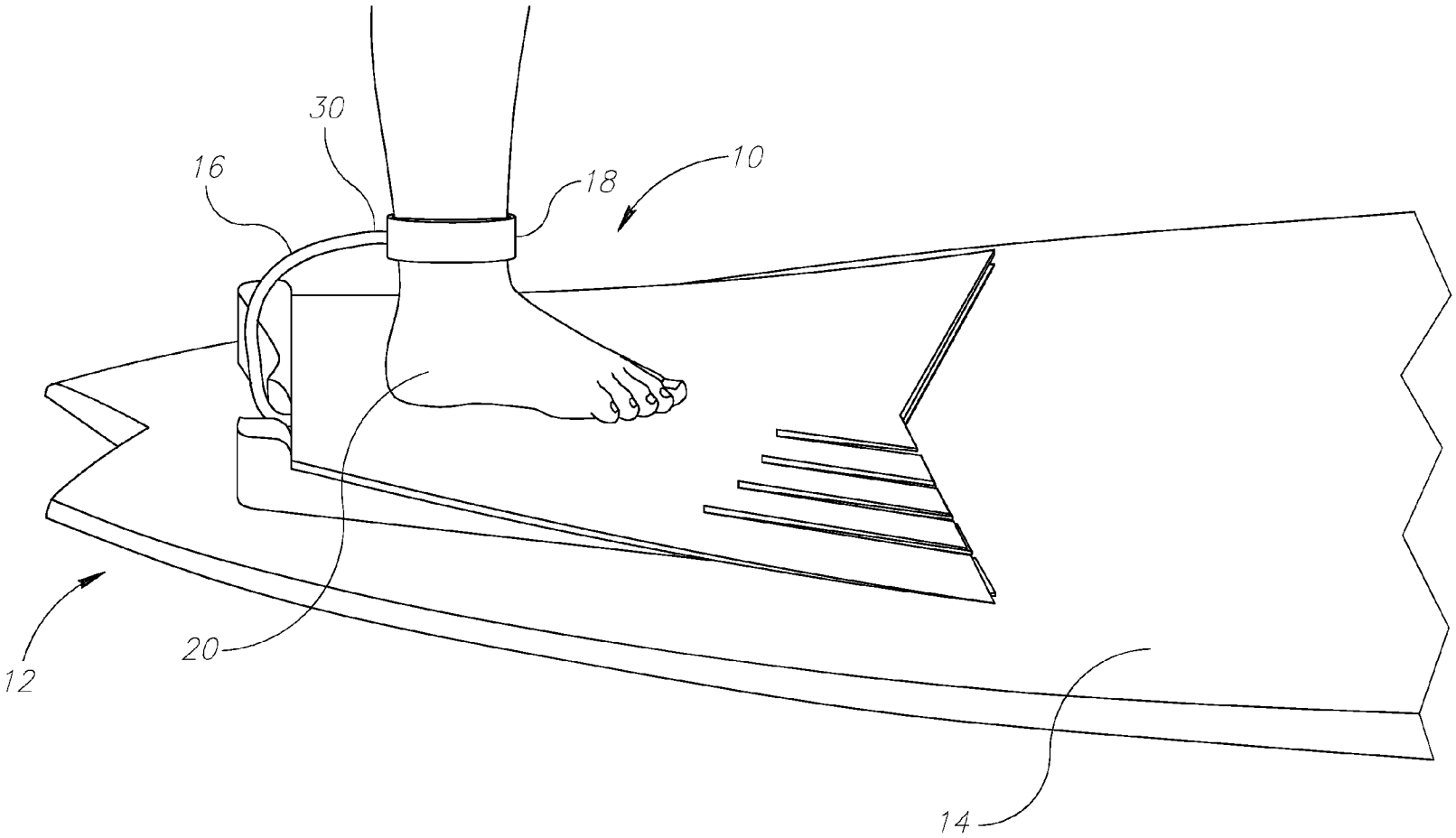
FIG. 1A shows the rear end of a surfboard having mounted thereon the unitary security accessory of the invention.
Figure 1B:
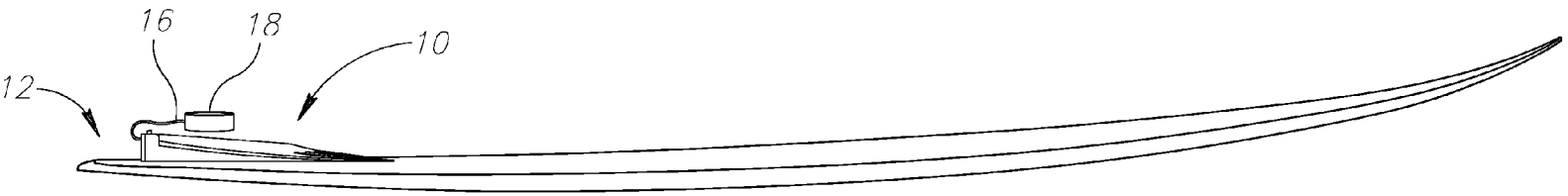
FIG. 1B shows the complete surfboard, a portion of which is shown in FIG. 1A, in profile.
Figure 2A:
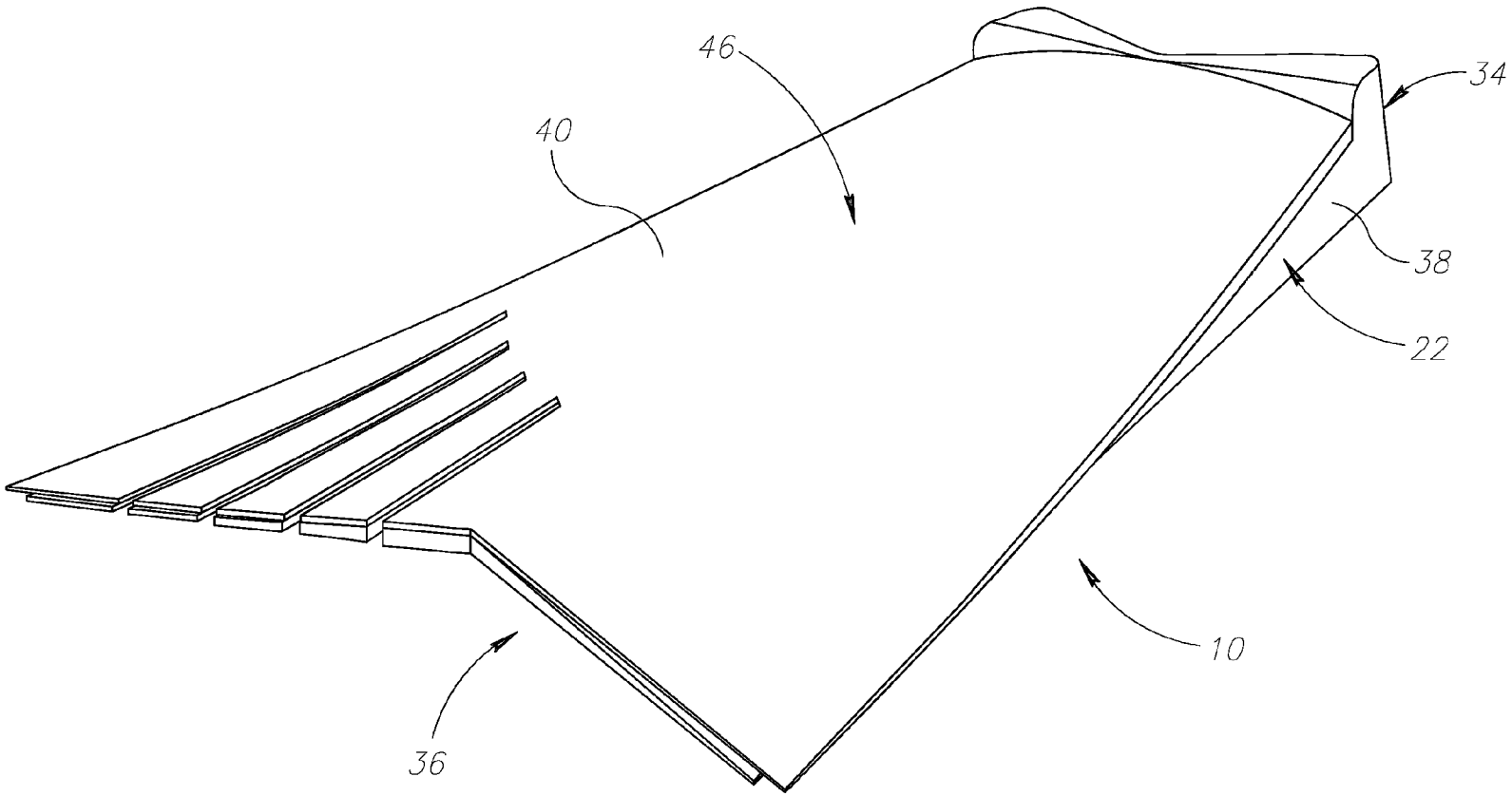
FIG. 2A is an isometric upper view of the accessory of the invention.
Figure 2B:
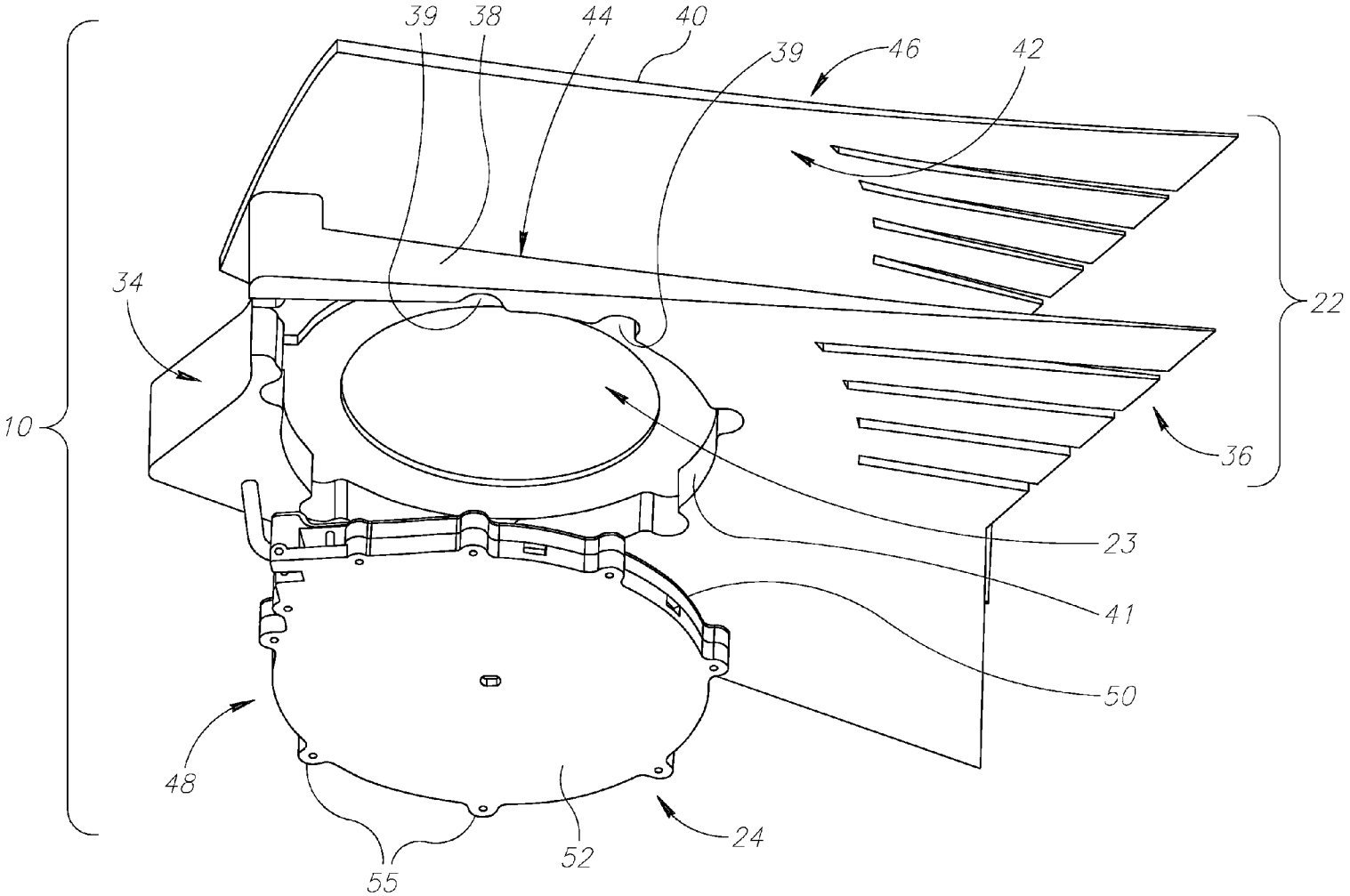
FIG. 2B is an exploded view of the accessory of the invention, as seen from the bottom.
Figure 2C:
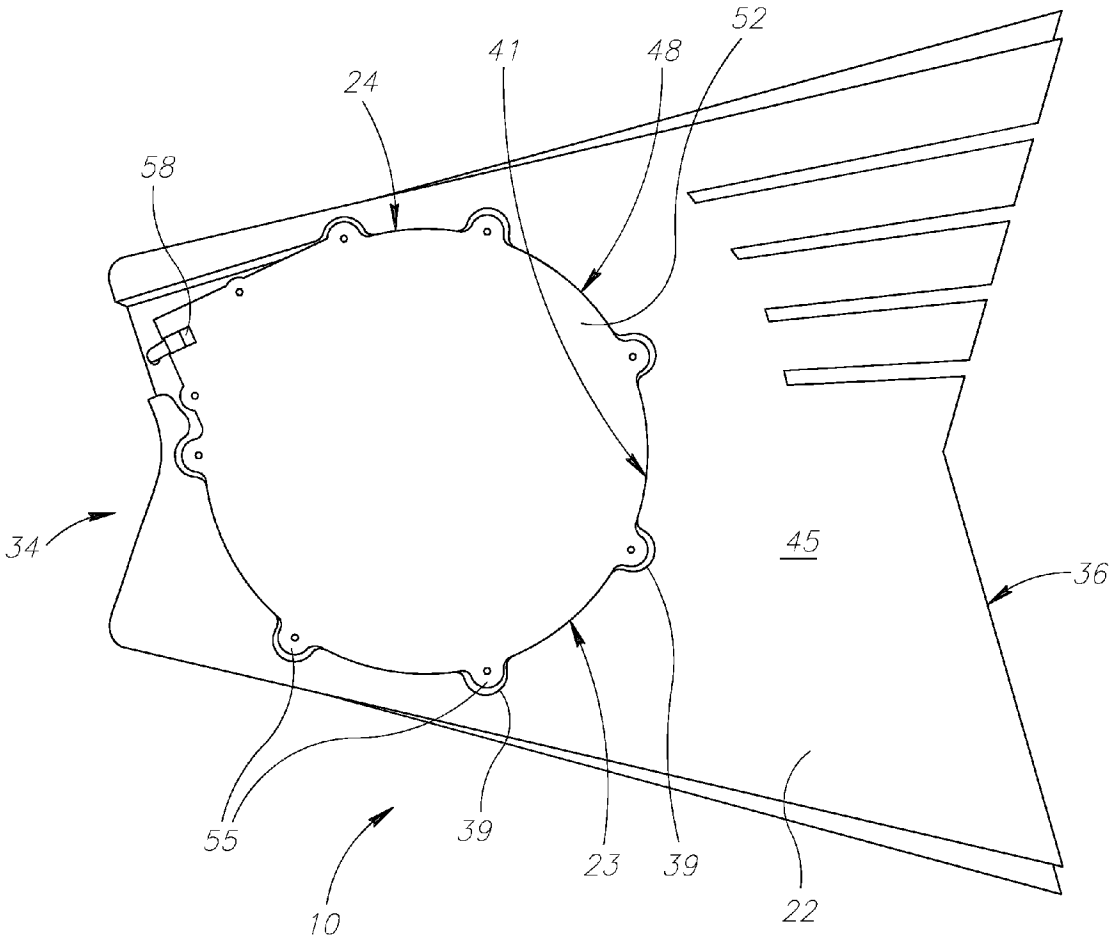
FIG. 2C is a bottom view of the accessory of the invention when assembled.
Figure 3:
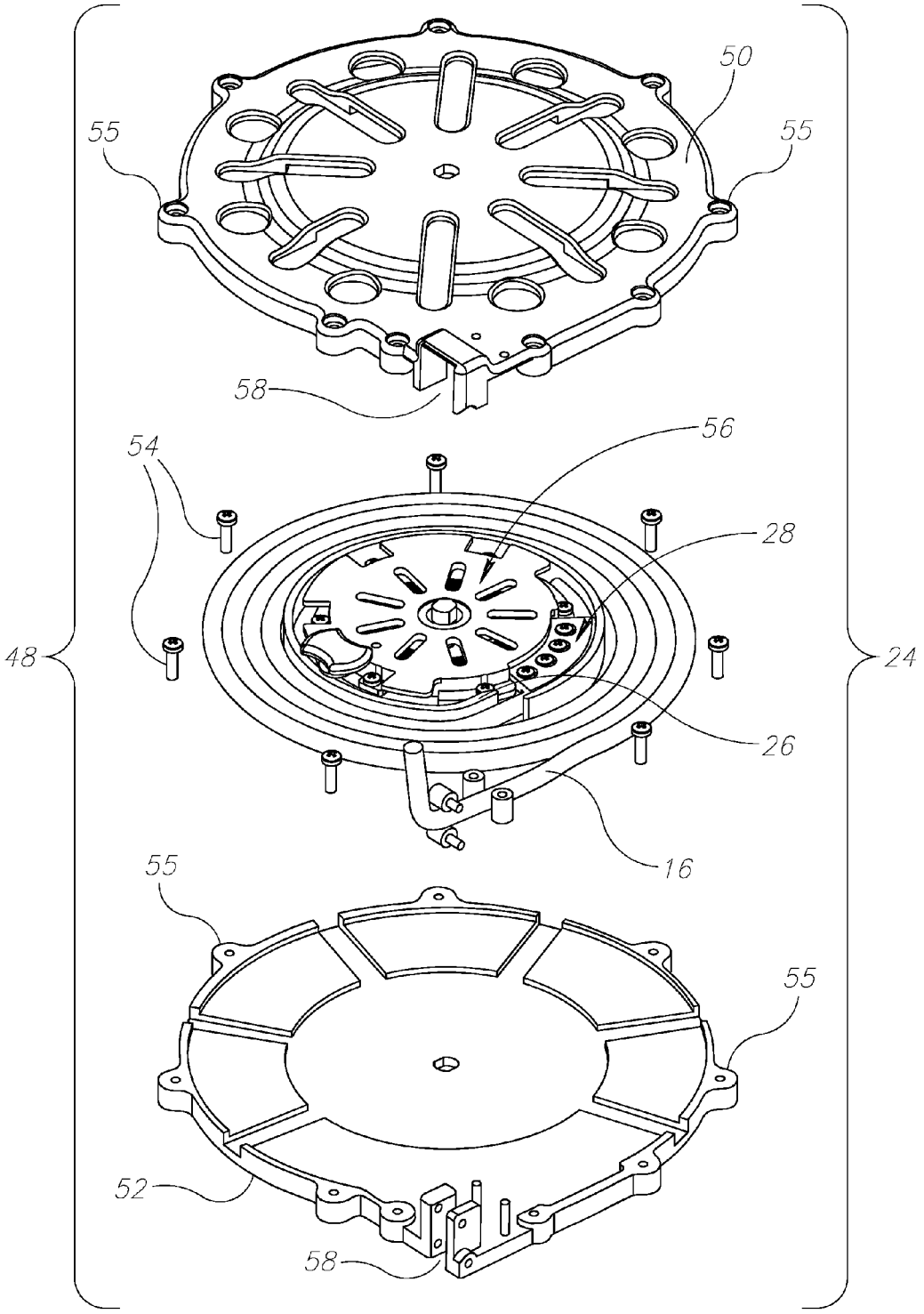
FIG. 3 is an exploded view of an example of a retractable leash assembly suitable for use in the present invention.

Referring now to FIGS. 1A and 1B, the present invention provides a unitary security accessory 10 which is adapted to perform the function of a conventional traction pad as well as that of a retractable leash. Traction pads, known also as 'tail pads', are commonly used by surfers to help their rear foot grip the surfboard by virtue of a high friction support surface. Traction pads are sold with a suitable adhesive on their bottom surface so that they can be fastened directly to the tail of the surfboard, without the need to use special tools or fasteners, and without requiring modification to the surfboard, per se.

Security accessory 10 is seen to be fastened to the tail, generally referenced 12, of a surfboard 14. It serves not only as a traction pad, as described below, but also, by means of a retractable leash assembly, shown and described below in conjunction with FIGS. 2B-4, serves to secure surfboard 14 to the surfer so as to prevent loss of the surfboard if the surfer falls off the surfboard. The only portion of the leash assembly shown in FIGS. 1A and 1B is a leash 16, terminating in a cuff 18, seen in FIG. 1A to be secured to the ankle 20 of a surfer. Leash 16 is typically made of a silicone, as known in the art.

Referring now to FIGS. 2A-4, accessory 10 has a body 22 in which is formed a storage compartment 23 for housing a retractable leash assembly 24 (FIGS. 2B-4) including leash 16 having a first end 26 anchored to an interior anchor location 28 (FIG. 3) and a second, free end 30 (FIG. 1A) terminating in cuff 18 (FIG. 1A), as described.

The body 22 of accessory 10 is generally wedge shaped, having a tapered configuration from a rear edge portion 34 to a front edge portion 36 thereof, so as to be shaped like a conventional traction pad.

Accessory body 22 may be formed, as in the present example, so as to be formed of a main body element 38 in which the storage compartment 23 is formed, and a deck element 40. When assembled, a lower surface 42 (FIG. 2B) of deck element 40 is fastened to an upper surface 44 (FIG. 2B) of main body element 38. Deck element 40 also has an upper surface 46 which is also the upper surface of security accessory 10 on which a surfer will normally position his rearmost foot when surfing, as with a conventional traction pad. Deck upper surface 46 is thus formed with a highly textured non-slip 'traction' finish as known in the art, for facilitating gripping by the surfer. A lower surface 45 (FIGS. 2C and 4) of main body element 38 and thus also of body 22, is generally flat, and is adapted for fastening to the surfboard tail 12, by use of any suitable adhesive as commonly known for fastening traction pads.

Typically, both main body element 38 and deck element 40 are formed of suitable foam materials; main body element 38 being made, for example, of Palfoam® PA30 and deck element 40 being made, for example, of Palfoam® PA125, both manufactured by the Palziv Group of Ein Hanatziv M.P. Emek Bet Shean 10805 Israel.

Referring now more particularly to FIGS. 2B-4, the leash assembly 24 is seen to include a generally disk-shaped casing 48 having upper and lower casing portions, referenced 50 and 52 respectively, shaped so as to store leash 16 in a generally flat wound arrangement. Typically, casing portions 50 and 52 are connected as by screws 54, attaching the casing portions to each other at peripheral protrusions 55. Main body element 38 is provided with recesses 39 (FIGS. 2B and 2C) formed in the side wall 41 of storage compartment 23, configured so as to engage protrusions 55 so as to resist undesired rotational movement of the casing when the leash assembly is in use. A spring-retained leash winding mechanism 56 (FIGS. 3 and 4) of any suitable construction is provided within casing 48 for normally retaining leash 16 in a wound arrangement, but also operative to facilitate unwinding and extension of leash 16 when a sufficient pulling force is applied. Casing 48 has a lateral opening 58 (FIGS. 2C and 3) adapted to facilitate passage of the leash when being retracted or extended.

Figure 4:
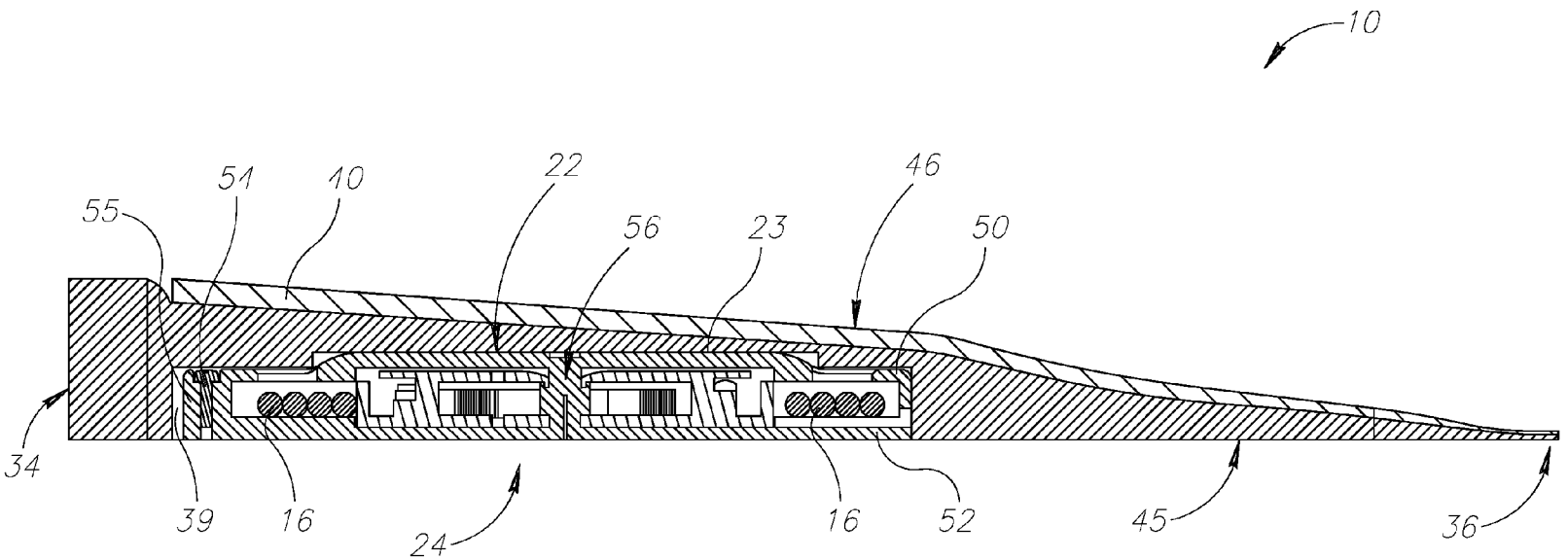
FIG. 4 is a cross-sectional view through the accessory of the invention, incorporating the exemplary leash assembly of FIG. 3.

In order to facilitate the casing 48 of the leash assembly 24 being contained fully within main body element 38, and easy assembly of the security accessory, the internal dimensions of storage compartment 23 match the external dimensions of casing 48. As seen in FIG. 4, in accordance with the present embodiment, when accessory 10 is fully assembled, casing 48 is flush with the lower surface 45 of main body element 38. The above-described engagement of protrusions 55 by recesses 39, together with the illustrated flush retention of casing 48 against the surfboard 14, particularly as seen in FIG. 4, ensures that the leash assembly casing 48 is properly anchored against undesired movement.

Figure 5A:
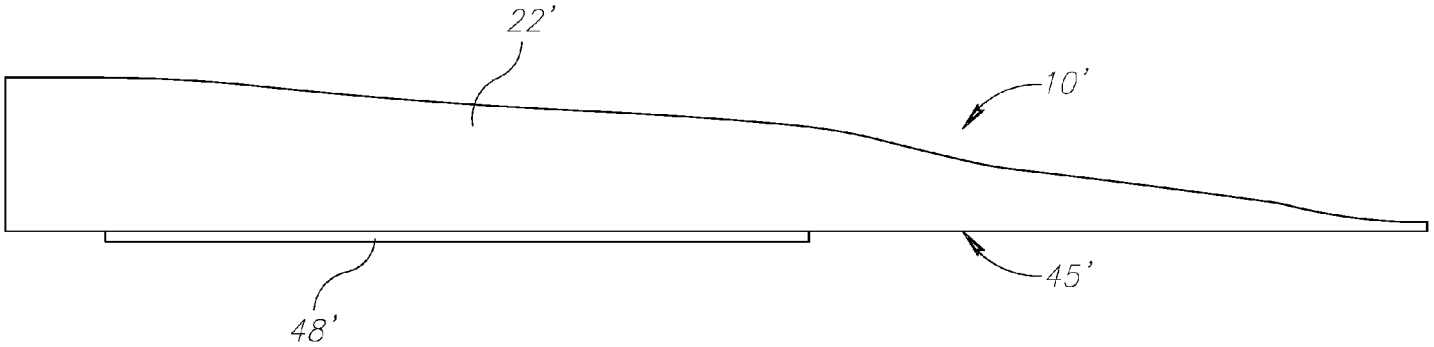
FIGS. 5A and 5B are schematic side views of the accessory of the invention in accordance with an alternative embodiment, before and after securing to a surfboard.
Figure 5B:
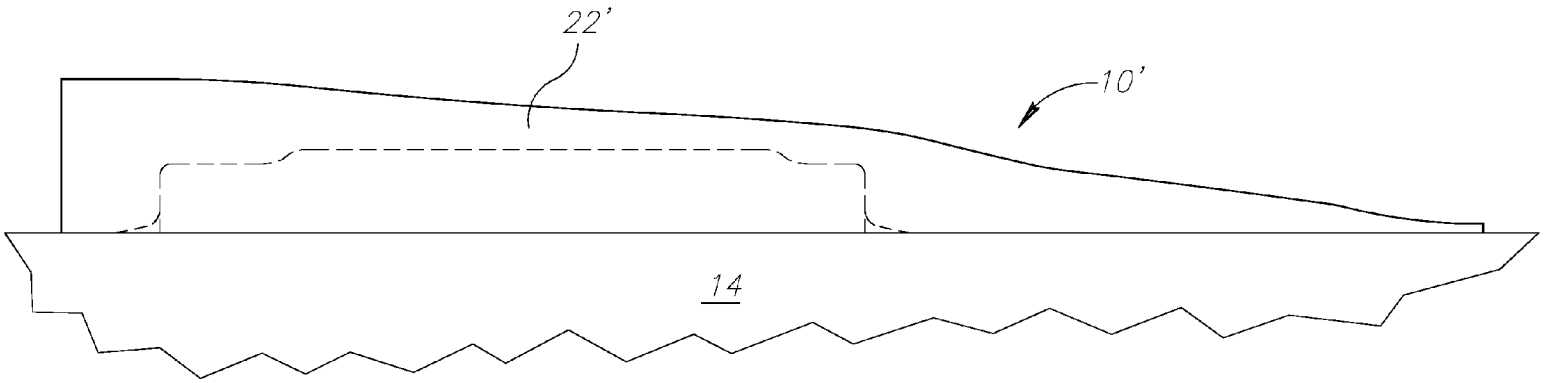

Referring now briefly to FIGS. 5A and 5B, there is illustrated an accessory 10' which is identical to accessory 10, except that body 22' may be slightly thinner than body 22 of accessory 10 (measured in the direction normal to lower surface 45 of body 22). In this situation, casing 48' may protrude beneath lower surface 45' of body 22', as seen. However, as shown in FIG. 5B, due to the flexibility of the foam materials from which the body 22' is typically made, as described above, accessory 10' may be mounted by use of a suitable adhesive to glue lower surface 45' surrounding casing 48' to the surfboard 14, and by pressing the body 22' onto the surfboard 14 until adhesion has been achieved. It will be appreciated that in all other respects, accessory 10' is identical to accessory 10 (FIGS. 1A-4) and that all references to portions, features and components of accessory 10 are intended to refer equally to such portions, features and components of accessory 10', even though such portions, features and components may not be specifically shown or described herein.

A particular feature of the security accessory of the invention is that the body 22 and leash assembly 24 fit together, as shown and described herein, in a fully integrated fashion, so as to, in effect, utilize the simple method of attaching a conventional traction pad to a surfboard for mounting a retractable leash assembly thereon.

It will be appreciated by persons skilled in the art that the present invention is not limited by what has been shown and described above, merely by way of example. Rather, the scope of the invention is limited solely by the claims, as follows:

I claim:

1. A unitary security accessory for a surfboard which comprises:

a retractable leash assembly including a retractable leash having:

a first end anchored to an interior anchor location within said leash assembly;

a second, free end for attaching to the ankle of a surfer;

a spring-retained winding mechanism for winding thereon said leash; and a generally disk-shaped casing configured to store said leash in a generally flat wound arrangement, wherein said winding mechanism is mounted within said casing and said casing has a lateral opening adapted to facilitate passage of said leash when being retracted or paid out;

a generally wedge shaped body having formed therein a storage compartment for housing said retractable leash assembly, said storage compartment communicating with the exterior so as to facilitate extension and retraction of said leash, wherein said disk-shaped casing has an overall thickness which is less than the thickness of said body at the location of said storage compartment, said body further having an upper surface for supporting the surfer; and a lower surface juxtaposed to an upper rear surface of the surfboard, wherein said wedge shaped body has a tapered configuration from a rear edge portion to a front edge portion thereof, wherein said storage compartment has an opening formed in said lower surface of said body, and wherein the internal dimensions of said storage compartment match the external dimensions of said casing such that said casing is fully engaged by said body when assembled therewith, thereby preventing undesired rotation of said casing relative to said body; and fastening means for fastening said lower surface of said body and thus said accessory to the upper rear surface of the surfboard.

2. A unitary security accessory for a surfboard which comprises:

a retractable leash assembly including a retractable leash having:

a first end anchored to an interior anchor location within said leash assembly;

a second, free end for attaching to the ankle of a surfer;

a spring-retained winding mechanism for winding thereon said leash; and a generally disk-shaped casing configured to store said leash in a generally flat wound arrangement, wherein said winding mechanism is mounted within said casing and said casing has a lateral opening adapted to facilitate passage of said leash when being retracted or paid out;

a generally wedge shaped body having formed therein a storage compartment for housing said retractable leash assembly, said storage compartment communicating with the exterior so as to facilitate extension and retraction of said leash, wherein said disk-shaped casing has an overall thickness which is less than the thickness of said body at the location of said storage compartment said body further having an upper surface for supporting the surfer;

a lower surface juxtaposed to an upper rear surface of the surfboard;

a main body element having a lower surface constituting said lower surface of said body, said storage compartment being formed within said main body element; and a deck element having an upper surface constituting said upper surface for supporting the surfer, wherein a lower surface of said deck element is fastened to an upper surface of said main body element, wherein said wedge shaped body has a tapered configuration from a rear edge portion to a front edge portion thereof, wherein said storage compartment has an opening formed in said lower surface of said body, and wherein the internal dimensions of said storage compartment match the external dimensions of said casing such that said casing is fully engaged by said body when assembled therewith, thereby preventing undesired rotation of said casing relative to said body; and fastening means for fastening said lower surface of said body and thus said accessory to the upper rear surface of the surfboard.

3. An accessory according to claim 2, wherein said disk-shaped casing of said leash assembly terminates in a bottom surface, and said storage compartment is configured so as to contain the entire thickness of said disk-shaped casing such that said bottom surface thereof does not protrude beyond said lower surface of said body when fastened to the surfboard.

4. An accessory according to claim 2, wherein said upper surface for supporting the surfer is a traction surface.

* * * * *